US005567952A

United States Patent [19]

Kirchner et al.

[11] Patent Number: 5,567,952

[45] Date of Patent: Oct. 22, 1996

[54] FIXING MEANS FOR THE BASE OF A RADIOACTIVE MATERIAL TRANSPORT AND/OR STORAGE CONTAINER

[75] Inventors: Bernard Kirchner, Gif sur Yvette; Rene Chiocca, Paris, both of France

[73] Assignee: Transnucleaire, Paris, France

[21] Appl. No.: 381,525

[22] Filed: Feb. 1, 1995

[30] Foreign Application Priority Data

Feb. 1, 1994 [FR] France ..... 94 01313

[51] Int. Cl.[6] ..... G21F 5/00

[52] U.S. Cl. ..... 250/506.1

[58] Field of Search ..... 250/506.1; 220/612, 220/618

[56] References Cited

U.S. PATENT DOCUMENTS

| | | | |
|---|---|---|---|
| 2,348,696 | 5/1944 | Schabacker | 29/84 |
| 4,133,094 | 1/1979 | Stafford | 29/447 |
| 4,633,091 | 12/1986 | Kurasch | 250/506.1 |
| 5,094,801 | 3/1992 | Dixon et al. | 376/307 |
| 5,432,828 | 7/1995 | Cayment et al. | 376/260 |

FOREIGN PATENT DOCUMENTS

| | | | |
|---|---|---|---|
| 0061400 | 9/1982 | European Pat. Off. . | |
| 0101362 | 2/1984 | European Pat. Off. . | |
| 0131177 | 1/1985 | European Pat. Off. | 250/506.1 |
| 0223925 | 6/1987 | European Pat. Off. . | |
| 0343410 | 11/1989 | European Pat. Off. | 250/506.1 |
| 2472819 | 7/1981 | France . | |
| 2112578 | 10/1971 | Germany . | |
| 154316 | 3/1982 | Germany . | |
| 1338273 | 11/1973 | United Kingdom . | |

*Primary Examiner*—Jack I. Berman

*Attorney, Agent, or Firm*—Dennison, Meserole, Pollack & Scheiner

[57] ABSTRACT

A container for transport and storage of highly radioactive material, the container being made of thick metal and comprising a tube having an internal wall and a base having a lateral wall, the base being non-removably sealed to one end of the tube, and the internal wall and lateral wall forming a right cylinder with circular cross-section in contact with each other. The base is fixed to the container by shrink fitting the lateral wall with a portion of the internal wall in contact with the lateral wall, the base being disposed such that the lateral wall is entirely inside the tube with a portion of the internal wall comprising an opposed shoulder which cooperates with the corresponding shoulder in the lateral wall. A first continuous seam weld is provided on an external surface of the base in contact with the tube and a second continuous weld seem is provided on an internal surface of the base in contact with the tube.

11 Claims, 3 Drawing Sheets

FIG. 3
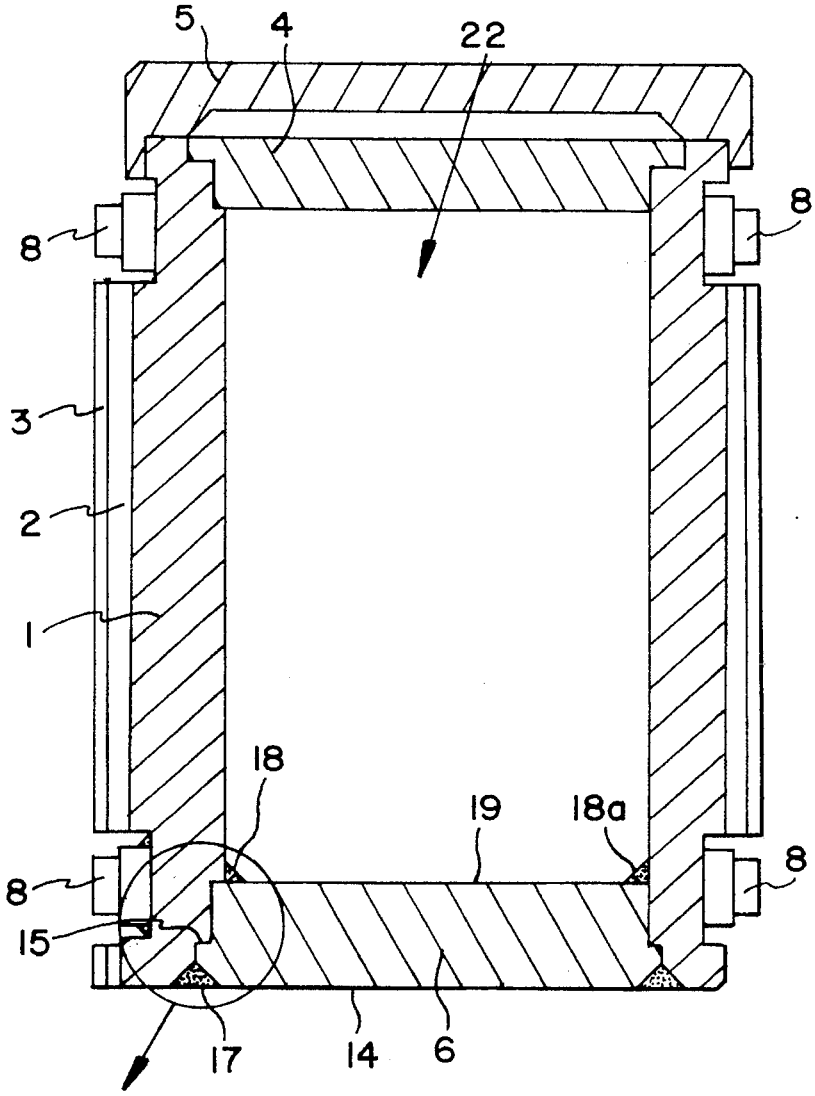
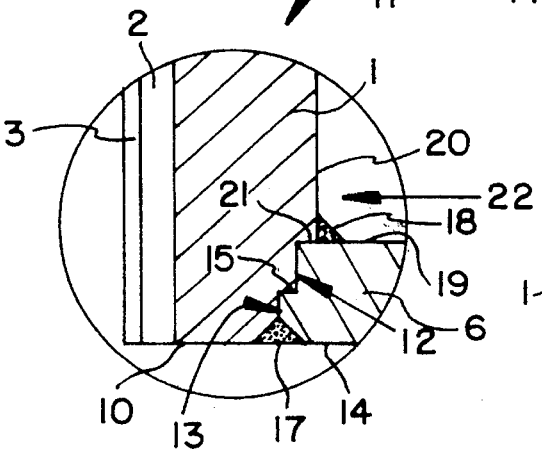
FIG. 3A
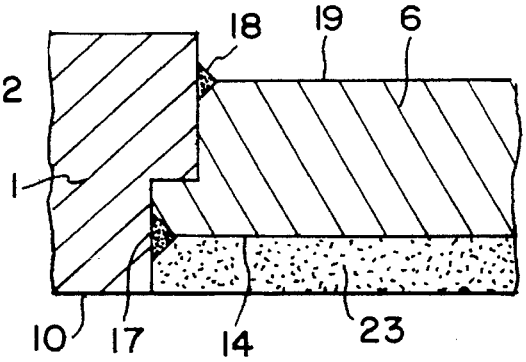
FIG. 3B

FIXING MEANS FOR THE BASE OF A RADIOACTIVE MATERIAL TRANSPORT AND/OR STORAGE CONTAINER

FIELD OF THE INVENTION

The invention concerns a fixing means for the base of a transport and/or storage container for highly radioactive material, in particular for irradiated nuclear fuel assemblies or their highly active reprocessing waste.

DESCRIPTION OF RELATED ART

Containers for highly radioactive material generally comprise a thick shielded chamber which confines the material, stops gamma radiation and is mechanically strong, even under accidental severe Conditions.

They are generally cylindrical with a cross section which is either completely circular or is provided with flats. They comprise a tube which is closed at one end by a base which is permanently fixed thereto. The other end constitutes the main opening which is closed by a removable plug or cover which is often complex, for filling and emptying the contents. These closures must remain sealed (sometimes even to helium) when under accidental severe conditions, in particular after regulation drop tests, for example a drop of 9 m along a tube generatrix, on a corner of the container, on the base or on the cover, including penetration drops.

The main frame of the tube and closures can be formed of a thick metal wall of high mechanical strength, for example a steel, which can be several tens of centimeters thick; thus containers for transport and/or storage of nuclear fuel assemblies or vitrified waste, the steel tube can be more than 25 or 30 cm thick, similarly the base and the main cover, and the unladen weight of the container assembly can be up to 120 t; its laden weight can be 150 t or more. The radiological shielding provided by the frame can be supplemented by layers of appropriate materials outside or inside the container, on the tube or on the end closures.

A known container type is illustrated in FIG. 1, which shows:

- thick tube (1), for example of steel, covered with further layers (2), (3) of radiation absorbing material. The main closure system comprises two covers, a primary cover (4) and a secondary protective cover (5), both removable. Particular fixing or monitoring apparatus are not shown;
- a non removable base (6) which in this case is fixed to tube (1) by a weld (7) through the entire thickness of the tube;
- handling lugs (8) which are generally welded across weld (7).

A weld of type (7) is long and difficult to make because of the great thickness of the steel which must be welded; great care is necessary and many checks must be carried out during manufacture because the weld alone holds the base in position and provides the drop strength as well as sealing the container.

This welding problem has been simplified by providing a further closure means as illustrated in FIG. 2. Base (6) has an external diameter which is equal to that of tube (1); it includes a Shoulder (9) at the periphery of the internal surface (19), which cooperates with the internal diameter of tube (1) and allows base (6) to be cold assembled with a light friction fit, fitted partially inside the tube and abutting the cross sectional surface of end (10) of tube (1). A peripheral weld seam, which is simpler to make and check than the weld described above, holds base (6) in place. It can be completed by a second weld seam (18) on the inner face.

In this type of assembly, here again a weld ensures that base (6) is held in place and seals the tube; the welds are extremely stressed if the container is accidentally dropped along a tube generatrix or at an angle to the base. As before, then, they must be made with extreme care and closely checked. They constitute a weak point there is a risk of rupture which cannot guarantee a complete seal in the event of a severe shock. European patent EP-A-0 061 400 describes a closure means for a container for radioactive material in which the seal is provided solely by Shrink fitting the (removable) cover into a tube (p.2, 1.37–38 to p.3, 1.30) which is brought about by an absence of faults in the contacting surfaces (p.4, 1.5–6). It also describes a boss (7) located On the tube on either side of the sealing surfaces, which is not in permanent contact with the removable cover and whose size is linked to the expansion of the tube. This thus creates an obstacle which cannot resist axial displacement of the cover (p.3, 1.31–32, 35–36, 39). French patent FR-A-2 092 502 describes a vacuum seal which is obtained by shrink fitting, one of the shrink fitted pieces being provided with an edge which deforms on contraction. European patent EP-A 0 101 362 describes a sealed closure for a removable cover produced by shrink fitting two conical portions, for a container for the transport of radioactive material; the contacting surfaces must be made with care (p.2, 1.9–10); the closure comprises an axial abutment and the cover projects beyond the tube.

These various assemblies cannot guarantee a seal in the event of a severe shock.

SUMMARY OF THE INVENTION

We have sought to overcome these problems and develop a means for assembling a base which is more secure and which avoids weak points with their associated rupture risks or affect the seal of the container in the event of the container being dropped, in particular horizontal or oblique drops, which are usually more severe, but also vertical drops, on the base or on the cover, including penetration drops.

We have also developed a simple assembly which is economical to manufacture.

The invention therefore concerns a means for fixing the base of a shielded container for transport and/or storage of highly radioactive material, comprising a tube and a non removable base of thick metal, for example steel, the tube and base having respectively, at least over a certain height, an internal wall and a lateral wall forming a right cylinder with a circular cross section in contact with each other, the base being held in place by shrink fitting its lateral wall with the portion of the internal wall of the tube in contact therewith, characterised in that the base is located at least partially inside the tube, in that said portion of the internal wall of the tube comprises a shoulder which cooperates with a corresponding opposed shoulder in the lateral wall of the base and in that the base is connected to the tube by a continuous weld seam on its external surface and by a further weld seam on its internal surface.

The base-tube closure is permanent.

The means of the invention ensures that the base will not displace relative to the tube, due to the shrink fitting in the event of a horizontal drop, due to the opposed shoulder in the event of a vertical drop on the base, and due to the combination of these two elements in the event of an oblique drop on the base. Thus, the weld seams which provide a perfect seal to helium only suffer weak stresses, for example due to the contents of the container rebounding in the event of a vertical drop on the cover. The welds can thus be smaller.

In general, a first weld seam connects the peripheral edge of the external surface of the base to the internal edge of the end face of the tube or the internal surface of the tube, the recessed base thus providing a volume which can usefully accommodate, for example, an additional incompressible neutron shield. Similarly, a second weld seam connects the peripheral edge of the inner surface of the base to the inner wall of the tube. These weld seams seal the container, in particular to confine radioactive material in the container cavity or to avoid contamination when immersed in a cooling pond. They are not highly stressed mechanically in the event of a drop, even in the event of a vertical or an oblique drop on a lower edge of the container, or event in the event of the load rebounding against the base in the event of a drop on the cover.

Thus the means of the invention not only significantly reduces the volume (up to –95%) and size of the welds, but also the specifications for these welds are less demanding. In particular, checks are simplified compared with those carried out of prior art welds, which latter play a major mechanical role in holding the base on the tube. This facilitates manufacture and provides cost advantages.

Shrink fitting ensures the absence base and the tube, by preventing any relative movement between these two pieces during a drop, thus maintaining the integrity of the welds.

To obtain this result, the facing surfaces during shrink fitting do not have to be as carefully prepared as would be necessary if the shrink fitting had to provide the seal for the container.

It should be noted that, in the means of the invention, the weld seams can also prevent the onset of corrosion at the base—tube interface, which corrosion can occur when the container is immersed in a cooling pond or as a result of condensation from the atmosphere and which would damage the base—tube joint; they can also prevent contamination from entering this interface.

The shoulder in the inner surface of the tube is in intimate contact with the corresponding opposed shoulder in the lateral wall of the base; it reduces stresses in the welds, primarily in the event of a vertical penetration drop in the centre of the base. It also ensures exact location of the base with respect to the tube.

Shrink fitting is generally carried out on the small and the large diameter to produce double shrink fit. It can also be effected solely on the small diameter (towards the container cavity); in both cases, the height of the opposed shoulder of the base resting on the shoulder of the tube can be adjusted so that its transverse strength is sufficient. Advantageously, the forged base is located substantially inside the tube, the external surface of said forged base or that of the optional complementary neutron shielding being flush with the end of the tube; this disposition distributes the shock over the base and tube in the event of a vertical drop.

Shrink fitting is effected by ensuring that the lateral wall of the base has a diameter which is slightly greater than that of the corresponding internal wall of the tube. The base is fitted into the tube after the two components have been heated to temperatures which are sufficiently different to provide a suitable temporary allowance for assembly.

After fitting, the external surface of the base advantageously does not go beyond the plane containing the end face of the tube, the base thus being located entirely within the tube. After cooling, the shrink fitting force develops over the whole of the lateral wall of the base, or over only a portion of its thickness, and is sufficient to hold it in place.

The shrink fitting is the stronger the larger the difference, when cold, between the diameter of the lateral wall of the base and that of the corresponding internal wall of the tube recommended, however, that this difference is kept below a limiting value above which the tensional strains in the tube and/or compressional strains in the base would go beyond the accepted threshold for the material used.

With the means of the invention, the shrink fitting force can be regulated by adjusting the value of the excess of the external diameter of the base when cold over the internal diameter of the corresponding internal wall of the tube, also when cold.

By way of example, when the base and tube are of steel and for a difference between their diameters of between 0–5 and 1 per thousand (which would necessitate a temperature difference of the order of 200K during assembly), the shrink fitting force at the interface can be of the order of 100 MPa, which is an acceptable value for most types of steel.

When the cavity of the container has a non circular cross section, in general the internal wall of the tube which contacts the base is machined to produce a circular cross section which cooperates with the circular lateral wall of the base during shrank fitting A wide variety of thick metals can be selected to form the tube and the base. The choice can be guided by mechanical properties, corrosion resistance, protection against radiation. etc. . . If required, different metals could be used for the base and tube- Preferably, the metal is selected from steels (optionally stainless) copper and its alloys, for example bronzes, etc. . .

Advantageously, the tube comprises handling lugs fixed on the external wall close to the base and the cover. With the fixing mode of the invention, the lugs near the base are fixed directly to the tube, for example by welding, and the weld does not interfere with other welds, unlike those of the prior art (see, for example, FIGS. 1 and 2). Welds which cross over One another generally run the risk of mutual embrittlement, and thus the absence of weld interference is an additional advantage of the invention.

The means of the invention, comprising a base which is held in place by shrink fitting, is particularly suitable for fixing the base of containers for highly radioactive material with very thick walls (base and tube) of metal, for example steel, typically 10 cm to 50 cm thick (generally 20 to 30 cm thick) and weighing more that 10 t (generally 70 to 150 t), Cooperation of the means employed in the invention also means that containers can be produced which are simple and thus economical to make, which satisfy specifications for transport and/or storage containers, including those for liquids, and in particular satisfy the requirements imposed by international regulations governing drop conditions or accidental severe shocks (including horizontal drops along a tube generatrix or obliquely at an angle to the tube near the base), while at the same time reducing the checks required during manufacture. The stresses occurring during a severe impact do not directly affect the weld seams of the base—tube interface.

Thus with the means of the invention, the forces which occur during severe shocks or drops do not damage the base—tube joint, thus improving not only the seal security but also corrosion protection and contamination protection of said base—tube interface. In addition, a simpler method of manufacture is employed which uses only known machining or welding techniques.

BRIEF DESCRIPTION OF THE DRAWINGS

FIG. 3 shows a vertical cross-section of a first container according to the invention;

FIG. 3*a* shows in detail a portion of the container of FIG. 3; and

FIG. 3*b* shows in detail a portion of a second container according to the invention.

DESCRIPTION OF THE PREFERRED EMBODIMENTS

FIG. 3 shows a container with a non removable base in accordance with the present invention. FIG. 3*a* shows an enlargement of the base—tube interface. FIG. 3*b* shows a detail of the base—tube interface in the particular instance where the base is recessed within the base.

Figure 1:
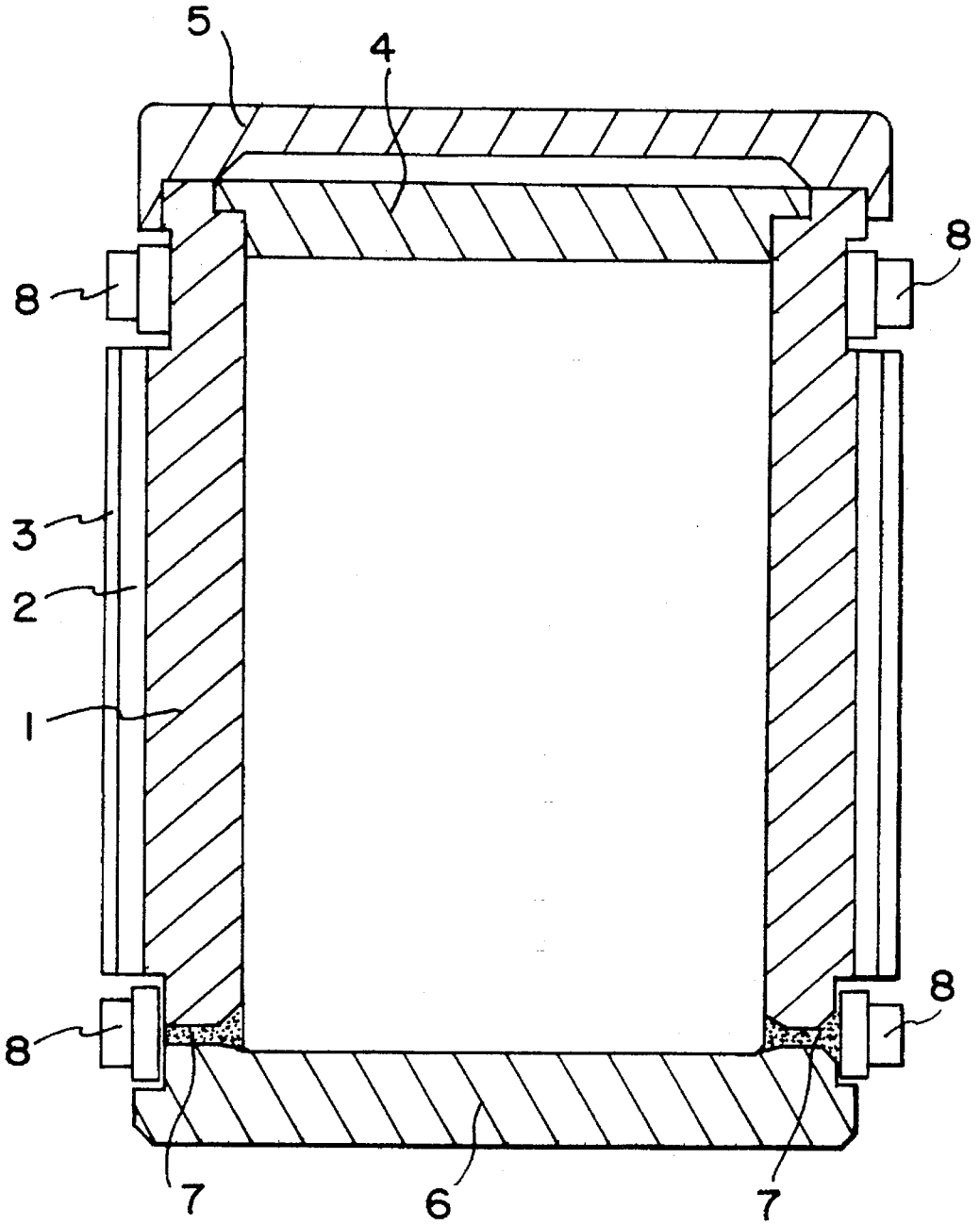
FIG. 1 PRIOR ART
FIG. 1 shows a vertical cross-sectional of a prior art container.
Figure 2:
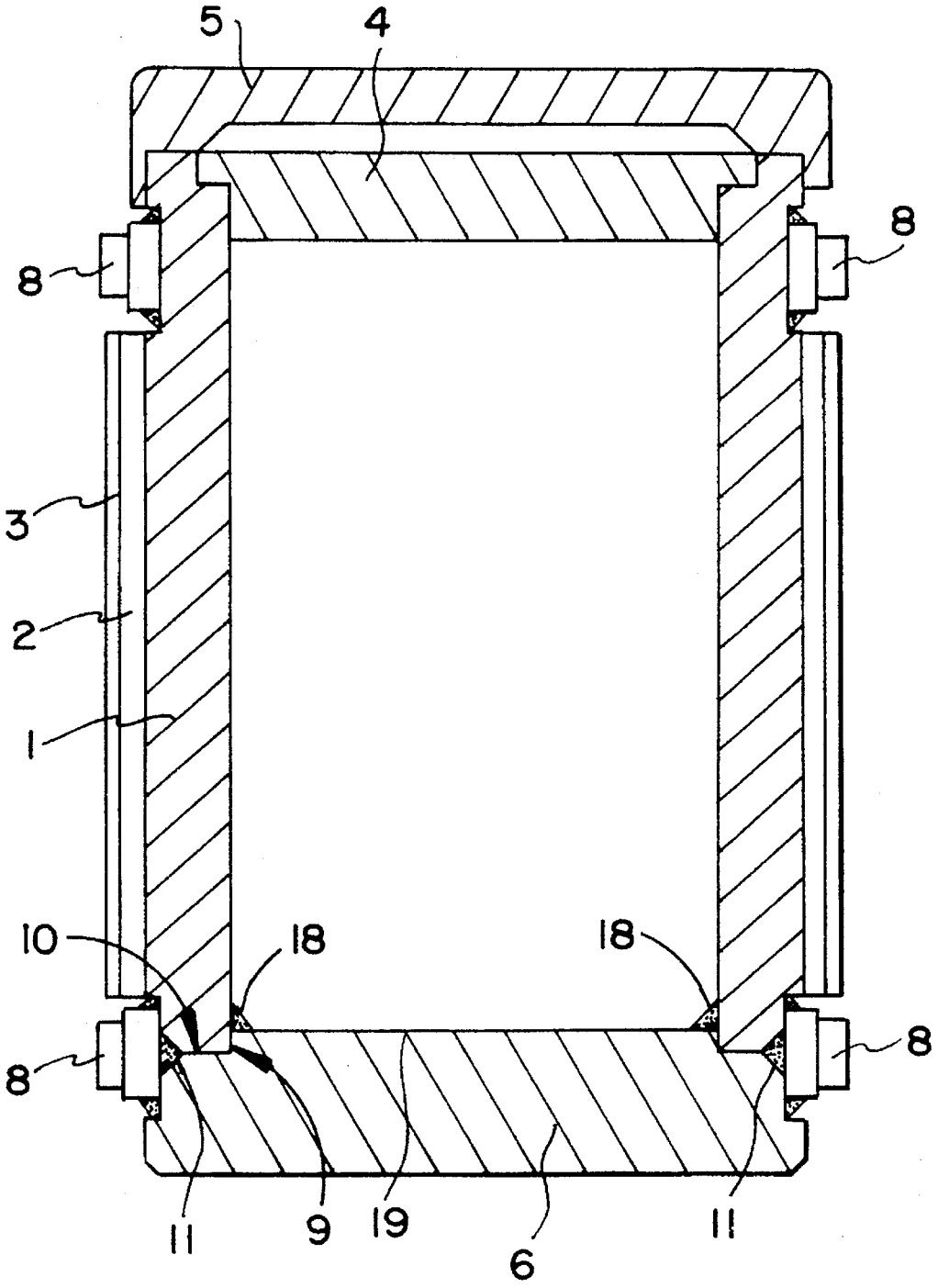
FIG. 2 PRIOR ART
FIG. 2 shows a cross-section of a second prior art container.

Reference numerals 1, 2, 3, 4, 5, 6, 8, 10, 18, 19 have the same meanings as in FIGS. 1 and 2 of the prior art. Base (6) is located inside tube (1), of steel or other strong metal, and has a peripheral lateral wall (12) which is cylindrical with a circular cross section and is enclosed over its entire height by an identical cylindrical portion (13) machined in the internal wall (20) of tube (1). In the figure, the external surface (14) of base (6) does not extend beyond the plane containing the end face (10) of tube (1). Base (6) is then held in place by shrink fitting using the tube (1) itself.

The cavity (22) of the container can be of any shape (for example with a polygonal cross section) such that its internal wall (20) requires a countersink (21) (FIG. 3*a*) to hold the base in place while other cavity (22) shapes (for example a circular cross section) would not require this countersink (see FIG. 3, 18*a*).

The following can also be seen:

the external weld seem (17) connects the peripheral edge of the external surface (14) of base (6) to the tube;

the internal weld seam (18, 18*a*) which connects the peripheral edge of the internal surface (19) of base (6) to the tube; and at (18*a*), the internal wall (20) of the cavity has no countersink (as described above).

Two cooperating shoulders (15) can also be seen, one machined in the inner wall of tube (1) and the other in the lateral (12) of base (6).

It can be seen from FIG. 3*b* that the external surface (14) of base (6) is not flush with the end face (10) of tube (1), but is within it: this forms a circular disk which can, for example, be used to hold additional incompressible neutron shielding (23). The sealing weld (17) thus connects the external surface (14) of base (6) to the internal surface of tube (1).

It should be noted that it could be advantageous to provide an allowance for assembly between base (6) and tube (1) in the vertical larger diameter portion (arrow 13) from the shoulder and it is preferable that this portion is of reduced height with respect to the smaller diameter portion (arrow 12). This is preferably sufficient to hold the base (6) in place even if it forms no part of the secure shrink fitting.

It should also be noted that, as described above, the countersink (21) of the tube can be partially or completely absent over the internal surface of the tube and may or may not coexist with shoulder (15). It may also replace shoulder (15).

What is claimed is:

1. In a container for transport and storage of highly radioactive material, the container being made of thick metal and comprising (i) a tube having an internal wall, and (ii) a base having a lateral wall, said base being non-removably sealed to one end of the tube, and said internal wall and lateral wall forming a right cylinder with a circular cross section in contact with each other, a means for fixing the base of the container, said means comprising:

(a) a shrink fitting of the lateral wall with a portion of the internal wall in contact therewith, the base being disposed such that the lateral wall is entirely inside the tube with said portion of the internal wall comprising an opposed shoulder which cooperates with a corresponding shoulder in the lateral wall;

(b) a first continuous weld seam on an external surface of the base in contact with the tube, and (c) a second continuous weld seam on an internal surface of the base in contact with the tube.

2. A means according to claim 1, wherein the external surface is flush with an end face of the tube.

3. A means according to claim 1, wherein the external surface is recessed in an end face of the tube.

4. A means according to claim 1, wherein the internal wall includes a countersink to hold the base in place.

5. A means according to claim 1, wherein the metal is selected from the group consisting of steels, copper, copper alloys, and bronzes.

6. A means according to claim 1, wherein handling lugs are fixed to a solid external wall of the tube near the base.

7. A container for transport and storage of highly radioactive material comprising:

a) a thick metal tube having first and second ends and an internal wall;

b) a thick metal base permanently sealing the first end of the tube, said base including an external surface, an internal surface and a lateral wall forming together with said internal wall a right cylinder of circular cross section in contact with each other, said lateral wall being disposed entirely inside the tube;

c) a shoulder portion on said internal wall at said first end;

d) a corresponding shoulder portion on said lateral wall, constructed and arranged for engaging the shoulder portion on said internal wall;

e) a first weld seam between said external surface and the tube; and f) a second weld seam between said internal surface and the tube, said tube and said base being in shrink-fit relationship at said first end.

8. A container according to claim 7, wherein said external surface is flush with said first end of the tube.

9. A container according to claim 7, wherein said external surface is recessed in said first end of the tube.

10. A container according to claim 7, which is helium tight.

11. A method for permanently joining a thick metal tube having an internal wall and first and second ends to a base having a lateral wall and external and internal surfaces, to form a container for transport and storage of highly radioactive materials, comprising the steps of:

a) forming a shoulder on the internal wall at the first end of the tube;

b) forming a corresponding shoulder on the lateral wall of the base, constructed and arranged for engaging the shoulder on the internal wall;

c) shrink fitting the base and the tube with the corresponding shoulders engaged and with the lateral wall entirely inside the tube;

d) forming a first continuous weld seam between the external surface and the internal wall; and e) forming a second continuous weld seam between the internal surface and the internal wall.

* * * * *